United States Patent [19]

Beard et al.

[11] 4,184,138

[45] Jan. 15, 1980

[54] OFFSET, SERIES CONNECTED CURRENT LIMITING FUSE AND EXPULSION FUSEHOLDER ASSEMBLY FOR OPENGATE CUTOUT

[75] Inventors: Lloyd R. Beard; Melvin B. Goe, Jr., both of Centralia, Mo.

[73] Assignee: A. B. Chance Company, Centralia, Mo.

[21] Appl. No.: 854,738

[22] Filed: Nov. 25, 1977

[51] Int. Cl.[2] ..... H01H 71/10; H01H 71/20

[52] U.S. Cl. ..... 337/168; 337/144; 337/169

[58] Field of Search ..... 337/144, 154, 168, 169, 337/170, 171, 172, 173, 174, 175, 176, 177, 180, 181, 178, 179; 200/149 A, 149 R; 361/104

[56] References Cited

U.S. PATENT DOCUMENTS

| | | | |
|---|---|---|---|
| 2,716,681 | 8/1955 | S. R. Smith, Jr. | 337/169 |
| 3,827,010 | 7/1974 | Cameron et al. | 337/169 |

*Primary Examiner*—Harold Broome

*Attorney, Agent, or Firm*—Schmidt, Johnson, Hovey & Williams

[57] ABSTRACT

A combination dropout assembly adapted for use with protective cutouts in an electrical distribution system comprises a current limiting fuse electrically connected in series with an explusion-type fuse, and mechanically coupled in skewed relation to the latter, whereby the assembly provides reliable full range fault current protection yet is sufficiently compact in length to matingly span the gate between conductive terminals of conventional 15 KV class opengate cutouts found in many existing electrical distribution systems. Overload and low to medium fault current protection is provided by the expulsion fuse, while high range fault currents are cleared by operation of the current limiting fuse. The oblique arrangement of the fuses relative to one another permits venting from either end of the expulsion fuse without directing potentially detrimental gases toward the current limiting fuse, and further allows the combination of various sizes of current limiting fuses and explusion fuses in the make-up of the dropout assembly such that protection characteristics of the latter may be tailored to preserve coordination of a particular distribution system.

4 Claims, 3 Drawing Figures

OFFSET, SERIES CONNECTED CURRENT LIMITING FUSE AND EXPULSION FUSEHOLDER ASSEMBLY FOR OPENGATE CUTOUT

BACKGROUND

This invention relates to current interrupting dropout assemblies of the type adapted to span the gate between the spaced terminals of an overhead distribution cutout. More particularly, it is concerned with a dropout assembly comprising a high range current limiting fuse in combination with an expulsion-type, low range current interrupter and adapted to mate with standard size open-gate cutouts in existing distribution systems to provide full range, non-violent fault current protection without adversely affecting coordination of the system.

With increasing demands for electrical energy, utility companies have been presented the problem of efficiently distributing more and more electrical power without significantly increasing the cost of distribution. Since it is virtually impossible from the standpoint of cost to replace existing distribution networks with improved higher rated systems, the conventional approach has been to simply upgrade the current rating of the older systems. Accordingly, there is a need in the industry for various types of higher rated electrical equipment designed for compatability with existing distribution hardware.

In order to safely and efficiently transmit increased currents, the upgraded systems must be capable of withstanding higher fault currents. This requirement presents a problem with regard to the expulsion-type fusible elements conventionally used to protect electrical distribution circuits from the effects of fault currents. In this regard, expulsion fuses of this variety typically have a maximum interrupting rating of 20,000 amperes whereas fault currents of much higher values may be experienced in today's higher current rated systems. Such high magnitude fault currents can cause a violent explosion of the expulsion fuse and may even result in damage to protected devices such as transformers or the like. In rare cases, transformers have themselves blown up as a result of experiencing an extremely high fault current. Of course, such violent failures are undesirable, especially in populated residential and urban areas where significant damage to property or life could result. Electrical linemen are particularly susceptible to injury from such an occurrence since, by the nature of their job, they are sometimes in close physical proximity with such electrical equipment when a high fault current is experienced.

In order to overcome the problems associated with the use of expulsion-type fuses, many utilities have employed current limiting fuses in order to protect their distribution equipment. However, while such fuses are well suited for handling even very high fault currents, they are notorious for their failure to operate in response to low overload or fault currents. Moreover, they adversely affect desired coordination of electrical systems designed around the time-current characteristics exhibited by expulsion-type fuses. Additionally, the expensive current limiting fuses are not reusable, even after clearing only a low fault current; consequently, the cost of maintaining a distribution system protected by current limiting fuse is significantly higher than maintenance costs for a similar system protected with expulsion-type fuses.

Various attempts have been made to overcome the aforementioned problems as evidenced, for example, by the devices disclosed in the U.S. Letters Patent to Fahnoe U.S. Pat. No. 2,917,605 and Cameron et al 3,827,010. Both of these devices provide a combination dropout assembly which includes a current limiting fuse disposed in line, and electrically coupled in series, with an expulsion-type fuse such that reliable full range protection is provided by the cutout. However, the devices shown in these patents have not proved commercially successful for one very important reason. Namely, the design of the in-line, combination dropout assemblies is such that in order to provide desired current-interrupting properties, the overall length of the dropout assemblies must necessarily be longer than the gate (spacing between terminals) of most cutouts found in existing distribution systems. Thus, in order to effectively utilize the invention of Fahnoe or Cameron et al, utilities would have to replace literally millions of cutouts presently in service. Such an approach would be prohibitive not only from the standpoint of equipment cost, but also, and perhaps more significantly, in view of the monumental labor cost associated with the replacement of these cutouts.

A similar device is illustrated in the patent to Jackson et al U.S. Pat. No. 4,011,537, though in this patent the current limiting fuse and expulsion fuse are each provided with insulating skirts to overcome the flashover tendancy sometimes exhibited in devices of this type. Notwithstanding this "improvement" however, the in-line combination dropout assembly of Jackson presents the same drawbacks discussed above with respect to compatability with equipment now in service.

Another approach to overcoming the problems discussed herein above is illustrated in the U.S. Letters Patent to Mahieu et al U.S. Pat. No. 3,863,187. Mahieu employs an expulsion-type fuse in series with a current limiting fuse, but disposes the latter "outgate" such that it does not form a part of the dropout assembly. One of several advantages presented by this construction is that the size of the current limiting fuse is not dictated by the spacing between the terminals of the cutout, and moreover, the full extent of this spacing is available for accomodating the desired length of expulsion-type fuse. Thus, this arrangement permits non-violent, full range protection without adversely effecting the overall coordination of the distribution system. However, one drawback of the Mahieu device is that replacement of the current limiting fuse is difficult, particularly in adverse weather conditions. In this connection, the current limiting fuse in Mahieu is necessarily positioned on the source side of the cutout in order to provide the desired operating characteristics. Thus, linemen are usually required to work on an energized portion of the line when replacing the current limiting fuse in the Mahieu device since utilities seldom, if ever, deenergize the distribution circuit for the purposes of permitting routine maintenance work. This problem is compounded by the fact that there is no method of readily determining whether the current limiting fuse has also operated, consequently, whenever the expulsion fuse portion of the Mahieu device actuates, recommended practice is to replace both the expulsion fuse and the current limiting fuse, the latter being subsequently tested to determine whether it is suitable for continued service.

SUMMARY

The present invention overcomes the foregoing problems by the provision of a combination dropout assembly wherein the current limiting fuse is physically coupled with the expulsion fuse in such a manner that the longitudinal axes thereof are offset from one another rather than being aligned as in the prior art devices. As a result of this construction, a substantial number of size combinations may be selected for the current limiting and expulsion fuses in the dropout assembly such that the latter may be tailored to provide operating characteristics compatible with virtually any electrical distribution system while at the same time remaining within the overall length limitation dictated by the size of the gate found in cutouts presently in service. By employing the principles of the present invention it is possible to construct a dropout assembly which provides reliable, relatively non-violent, full range fault protection without altering desired coordination of the distribution system or requiring replacement of existing cutouts.

Further, the offset construction of the present invention permits replacement of the fuse link in the expulsion fuse without separating the current limiting fuse therefrom as required in the in-line combination dropout assemblies. Other advantages offered by the present invention over prior art devices are: the ability to vent the expulsion fuse at either or both ends of the fuseholder as desired, assurance that venting of the expulsion fuse is never directed toward the current limiting fuse, ability to increase the distance between the cutout insulator and the exposed electrical coupling between the current limiting and expulsion fuses, improved dropout action because of advantageous weight distribution in the dropout assembly, ability to employ multiple current limiting fuse devices if desired, and compatibility with fuse links having buttonheads of various thicknesses.

In the drawing:

FIG. 1 showing an offset, series connected current limiting fuse and expulsion fuseholder dropout assembly constructed in accordance with the principles of the present invention and shown operably coupled with an opengate cutout;

Figures 1, 2, 3:
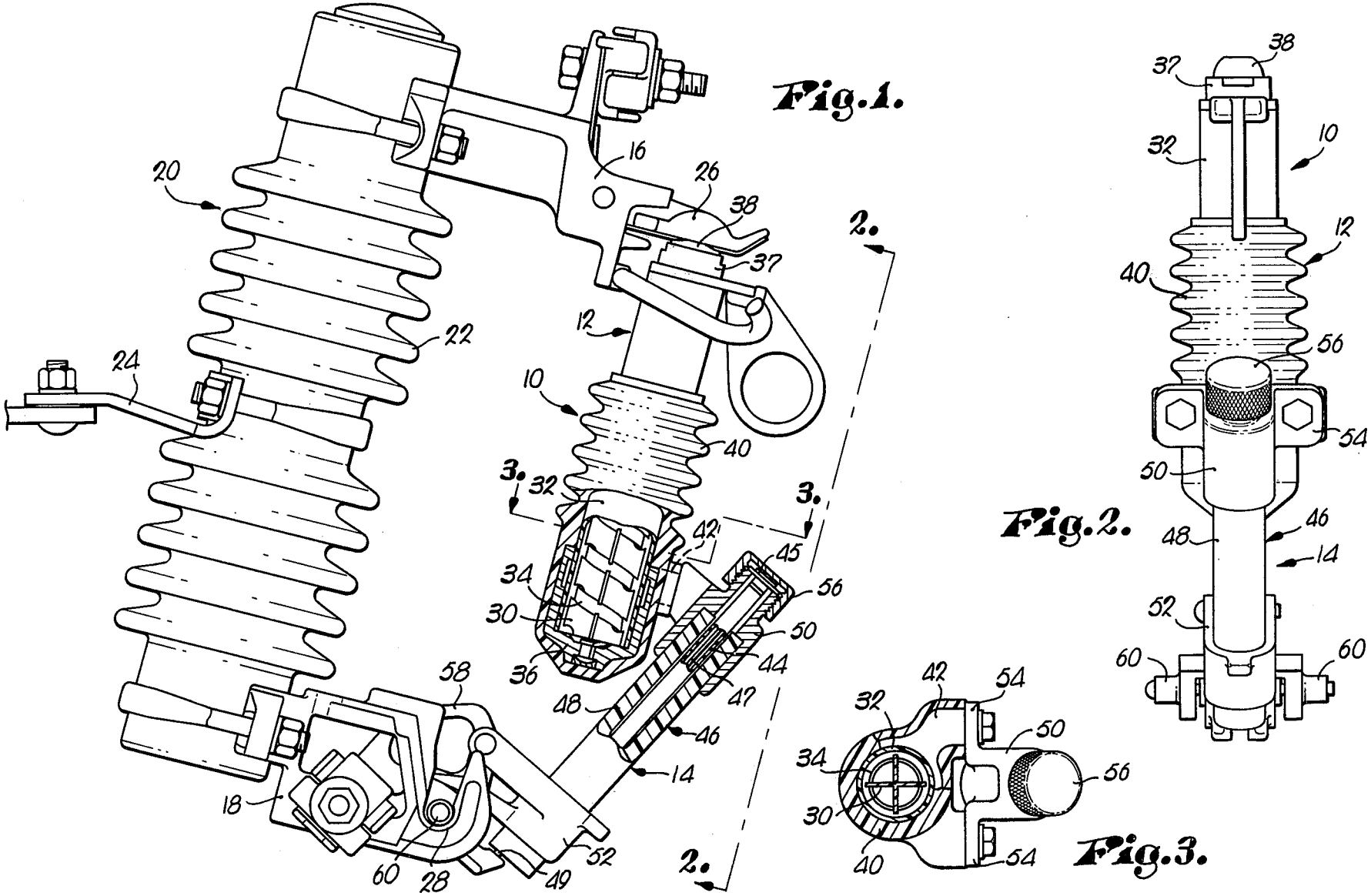
FIG. 2 is a view of the dropout assembly taken along line 2—2 of FIG. 1.
FIG. 3 is a cross-sectional view taken along line 3—3 of FIG. 1.

There is shown in the drawings a dropout assembly 10 comprising a high range current limiting fuse 12 obliquely mounted on, and electrically coupled in series with, an expulsion-type fuse 14. The assembly 10 is shown operably disposed within the gate between the line terminals 16, 18 of a 15 KV class or typical 7.2/14.4 KV dual rated cutout 20 of the variety conventionally employed in overhead power distribution systems.

In addition to the terminals 16, 18, an elongate, a skirted insulator 22 having a centrally disposed cross-arm mounting bracket 24 adapted for supporting the cutout 20 on the overhead cross-arm of a utility pole (not shown). The terminals 16, 18 are attached to opposite ends of the insulator 22 such that there is defined a gate between the spaced terminals 16, 18. The terminal 16 is provided with a yieldably biased latch 26 for releasably engaging the current limiting fuse 12 when the assembly 10 is disposed within the gate between the terminals 16, 18; the terminal 18 is provided with cradle structure 28 for the purpose of pivotally engaging the expulsion fuse 14 in a manner to be described hereinbelow.

The current limiting fuse 12 is of the type disclosed in the previously mentioned U.S. Pat. No. 3,863,187. The fuse 12 includes a finned saddle member 30 centrally disposed within a protective cylinder 32 and a fusible element 34 helically wound around the member 30 as shown for example in FIG. 1. The element 34 is electrically connected at one end to a conductive cap 36 and similarly connected at its opposite end with a conductive plug 37 having a conductive cap 38 configured to releasably engage the latch 26 of terminal 16. The cap 36 and the end of cylinder 32 associated therewith are sealed within an epoxy encapsulant 40 having annular skirts molded therein for enhancing the dielectric recovery across the external surface of the current limiting fuse 12. A pair of mounting bosses 42 on the cap 36 extend through the encapsulant 40 along one side of the fuse 12 to present a pair of exposed electrical contact surfaces. In the preferred embodiment, the fuse 12 is adapted to actuate in response to fault currents exceeding 500 amps.

The expulsion fuse 14 comprises a fuse link 44 in combination with a supporting fuseholder 46. The fuseholder 46 includes an elongate expulsion tube 48, an upper conductive mount 50 secured at one end of the tube 48 and a lower conductive mount 52 secured at the opposite end of tube 48 in spaced relation to the mount 50.

The fuse link 44 is of conventional construction including a solid buttonhead 45 adapted to be complementally received within a recess in the mount 50, an enclosed fusible element 47 adjacent the buttonhead 45 and a flexible leader 49 extending from the element 47.

Mount 50 is provided with a pair of skewed contact ears 54 adapted to be bolted against respective contact surfaces presented by the bosses 42 on end cap 36. This mounting arrangement between the ears 54 and bosses 42 serves not only to establish an electrical contact between the current limiting fuse 12 and the expulsion fuse 14 but also to mechanically couple these components in a highly advantageous manner. In this connection, it is to be noted that when viewing the dropout assembly 10 in side elevation as shown for example in FIG. 1 the longitudinal axis of the current limiting fuse 12 is disposed obliquely relative to the longitudinal axis of the expulsion fuse 14. Moreover, the arrangement between the fuses 12, 14 is such that the current limiting fuse 12 is not intersected by the longitudinal axis of the expulsion fuse 14. Hence, the expulsion fuse 14 can vent in either direction without concern that the current limiting fuse 12 might be detrimentally affected by expelled gases.

In this regard, the upper mount 50 is provided with a solid removable cap 56 for the purpose of providing access to the fuse link 44 and for sealing the tube 48 such that venting occurs only through the end associated with the lower mount 52. It is to be understood, however, that the cap 56 may be replaced with an expendable type cap should it be desired to permit venting through the opposite end of tube 48 as well. It is contemplated that when venting through this end of the tube 48 it may be desirable to provide a shield or tube extension for doubly protecting the fuse 12 against expelled gases.

As shown for example in FIGS. 1 and 2, the lower mount 52 has a pair of opposed trunnions 60 adapted to be received within respective cradle structures 28 on terminal 18 when the dropout assembly 10 is coupled with the cutout 20.

Additionally, the lower mount 52 forms a part of a toggle linkage by virtue of its pivotal connection with a supporting link 58. The link 58 is provided with conventional structure (not shown) adapted to engage the flexible leader 49 (shown only in FIG. 1) of the fuse link 44. The link 58 is spring loaded in a manner well known in the art such that link 44 is normally in tension when assembly 10 is positioned to close the gate of cutout 20. Hence, when element 47 is fused by a fault current, the toggle linkage comprising mount 52 and link 58 shifts in a manner to permit release of the coupling between conductive cap 38 and the latch 26, whereupon the assembly 10 is caused to swing in a clockwise direction (when viewed as in FIG. 1) thereby opening the gate between the terminals 16, 18.

In use, the dropout assembly 10 is typically mounted within the gate of a 15 k.v. class cutout, as for example, the cutout 20 shown in FIG. 1. Of course, cutout 20 is normally interposed in the electrical circuit of a distribution system with line terminal 16 being coupled to a source side conductor and line terminal 18 being coupled to a load side conductor. Thus, under normal operating conditions current is simply permitted to pass through the cutout 20 by virtue of the electrical path presented by the dropout assembly 10.

Should a low range fault current or overload current exceeding the rating of the fuse link 44 be experienced at the cutout 20, the fuse link 44 operates releasing the flexible leader 49 which in turn permits shifting of the toggle linkage defined by link 58 and lower mount 52. As previously described, operation of this toggle linkage permits cap 38 to disengage latch 26 thereby allowing the dropout assembly 10 to swing downwardly, under the influence of gravity, about trunnions 60 such that the gate between terminals 16, 18 is opened. This operation, of course, effectively isolates the troubled circuit from the remaining portions of the distribution system and further provides a ready visual indication that the cutout 20 has actuated.

On the other hand, should a relatively high magnitude fault current of the type expected to produce a violent expulsion in-fuse 14 be encountered at the cutout 20, the fusible element 34 and current limiting fuse 12 operates to quickly interrupt the fault current such that the violent operation of the fuse 14 as well as damage to the electrical circuit is precluded. Actuation of the current limiting fuse 12 is normally accompanied by relatively non-violent operation of the expulsion fuse 14 and attendant release of the assembly 10 such that there is provided a desired visual indication that the protective device has operated.

The dropout assembly 10 is intended to be an interchangeable device such that the entire assembly 10 is replaced in the field when either the expulsion fuse 14 or the current limiting fuse 12 has operated to interrupt the fault current. Replaced assemblies 10 may be subsequently refurbished in the shop for return to service. In cases where only the expulsion fuse 14 has operated, the assembly 10 can be rendered suitable for service by simply replacing the fuse link 44 in a well known manner. If on the other hand, it is determined that the current limiting fuse 12 has operated as well as the expulsion fuse 14, the current limiting fuse 12 is also replaced by simply removing the bolts securing contact ears 54 to the bosses 42.

By virtue of the unique arrangement of the dropout assembly 10, a wide range of size combinations of the fuses 12, 14 may be employed without rendering the assembly 10 incompatible with the cutout 20. In this connection, note that there is ample room to extend the length or expand the diameter of either the current limiting fuse 12 or the expulsion fuse 14, without exceeding the overall length restriction imposed by the spacing between terminals 16, 18 of cutout 20. Moreover, with the design of the present invention it is possible to vent the expulsion fuse 14 at either end as opposed to the prior art in-line arrangement where only the lower end of the expulsion fuse could be vented.

A further important advantage of the present invention is the fact that the exposed portions of the coupling between the fuses 12, 14 (i.e. upper mount 50 and cap 56) are spaced a substantial distance from the grounded mounting bracket 24 thereby significantly increasing the dielectric therebetween. Such arrangement is particularly significant in view of the fact that the mount 50 can not be completely encapsulated without eliminating the desired access for replacement of the fuse link 44.

Yet another advantage offered by the arrangement of the present invention is the fact that much of the expulsion fuse 14 is well spaced from the trunnions 60 such that a greater moment is produced thereabout to aid in the dropout of the assembly 10 when fuse link 44 operates.

All of the above advantages are realized without experiencing any of the disadvantages attributed to mounting the current limiting fuse outgate. Replacement of both the current limiting fuse 12 and the expulsion fuse 14 may be accomplished quickly and easily without necessitating working on hot lines.

What we claim is:

1. An electrical current interrupting device, comprising:

a pair of electrical terminals for coupling to respective electrical conductors;

elongated insulator means for supporting said terminals in spaced, electrically insulated relationship to one another;

a current interrupter for normally bridging and electrically interconnecting said terminals; and means for releasably mounting said current interrupter generally between said terminals, and for permitting said interrupter to shift out of said normal bridging position generally between said terminals in response to current flow through the interrupter of a first predetermined magnitude, said interrupter including:

an expulsion fuse comprising an elongated, tubular fuseholder having at least one gas venting end, and a fuse link within the fuseholder adapted to sever in response to current flow of said first predetermined magnitude;

an elongated current limiting fuse adapted to actuate in response to a current flow between said terminals of a second predetermined magnitude greater than said first magnitude;

means for electrically interconnecting said current limiting fuse and fuse link in series, and for mechanically connecting the current limiting fuse and fuseholder such that the longitudinal axes of said fuseholder and current limiting fuse are obliquely oriented relative to one another;

the longitudinal axis of the fuseholder does not intersect said current limiting fuse;

the longitudinal axis of said fuseholder is obliquely oriented relative to the longitudinal axis of said insulator means; and at least a portion of said current limiting fuse is disposed between said insulator means and the corresponding portion of said fuseholder disposed in the central region of said device between said terminals, whereby, said corresponding portion of the fuseholder is spaced a maximum distance from said terminals and insulator means and, upon severance of said fuse link, the gases emitted from said venting end are directed obliquely away from said current limiting fuse and insulator means.

2. The electrical current interrupting device as set forth in claim 1 wherein the longitudinal axis of said current limiting fuse is substantially parallel with the longitudinal axis of said insulator means.

3. The electrical current interrupting device as set forth in claim 1 wherein the lower end of said fuseholder is open for venting of gases therefrom, and said corresponding portion of said fuseholder is the upper end thereof, said upper end of the fuseholder being closed by means of a removable cap.

4. The electrical current interrupting device as set forth in claim 1 wherein said insulator means is mounted on an upright axis with said electrical terminals spaced along the length of the insulator means, the upper end of said current limiting fuse being in releasable electrical contact with the uppermost terminal, and the lower end of the expulsion fuse being adjacent the remaining terminal.

* * * * *